United States Patent [19]

Punater

[11] 3,938,437

[45] Feb. 17, 1976

[54] VARIABLE SPEED UNWIND CONTROLLER DRUM

[75] Inventor: Dinesh Gulabrai Punater, Kettering, Ohio

[73] Assignee: Harris-Intertype Corporation, Cleveland, Ohio

[22] Filed: Feb. 27, 1974

[21] Appl. No.: 446,138

[52] U.S. Cl. ..... 101/228; 74/354; 101/225; 226/178; 242/75.44

[51] Int. Cl.²B65H 77/00; B65H 23/18; B41F 13/02

[58] Field of Search ..... 101/212, 216, 219, 225, 101/228; 226/178; 74/354, 413, 414, 421 R; 242/75.44

[56] References Cited

UNITED STATES PATENTS

| | | | |
|---|---|---|---|
| 3,026,011 | 3/1962 | Grass | 226/178 |
| 3,038,678 | 6/1962 | Papst | 226/178 |
| 3,049,078 | 8/1962 | Smith, Jr. | 101/228 |
| 3,051,012 | 8/1962 | Sato | 74/354 |
| 3,249,316 | 5/1966 | Loase | 242/75.44 |
| 3,418,932 | 12/1968 | Macchoine et al. | 101/228 |
| 3,464,610 | 9/1969 | Koning | 226/178 |
| 3,564,935 | 2/1971 | Vigneri | 74/354 |
| 3,580,097 | 5/1971 | Dalen | 74/421 R |
| 3,684,147 | 8/1972 | Ysbrand et al. | 226/178 |
| 3,713,420 | 1/1973 | Pfaffle | 101/228 |

*Primary Examiner*—Edgar S. Burr
*Assistant Examiner*—William Pieprz
*Attorney, Agent, or Firm*—Biebel, French & Bugg

[57] ABSTRACT

The unwind controller drum for metering web material into a web processing machine is positively driven by a positive, fixed-ratio drive train. Several drive ratios are selectively available, each differing only slightly from another to provide minute changes in the drive ratio from the drive to the unwind drum. The changes in drive speed are generally less than .05% to provide positively determined, finite adjustment of the rate that the web material is metered into the web processing equipment.

12 Claims, 6 Drawing Figures

VARIABLE SPEED UNWIND CONTROLLER DRUM

BACKGROUND OF THE INVENTION

This invention relates to web processing equipment, and more particularly to machinery for preparing continuous business forms.

The preparation of continuous business forms has long provided unique and difficult challenges. The forms are prepared in substantial lengths and usually include several layers (e. g., a top original layer, an intermediate carbon, and a bottom copy). Each layer is normally separably joined to the others, and each individual form is joined to the next form in its own layer by lines of perforation, so that the forms may be used continuously and then separated one by one, as needed. This requires extreme accuracy in the manufacturing of these forms, since even the smallest dimensional errors may prove intolerably cumulative when repeated over the length of several hundred forms.

With conventional, single sheet (or single copy) printing, each page (or each few pages, as in a signature) is separated from the others, and at some point individually trimmed to size. In a typical press run, therefore, slight differences in size are customary and are accommodated routinely when the individual pages are sized.

Such is not the case, however, with continuous business forms. If the upper (original) copy of a business form is perhaps 0.001 inch longer than its corresponding duplicate (the one to be located beneath it), then a continuous roll of one thousand such forms will find the last upper (original) form shifted one inch out of registry with its corresponding lower (duplicate) form. Tolerances must actually be much closer than this, and it has therefore been common practice in the industry not to use conventional printing press methods, since they do not produce the accuracies required.

Much of the difficulty is in the paper itself: it is a physical material and therefore has a modulus of elasticity. It elongates when tensioned and returns when released. The amount is small but can be significant over the length of a roll of continuous forms. Similarly, variations in moisture content from one portion of the paper to another will lengthen the more moist portions. Typically, the edges of a roll of paper absorb moisture during storage, and the edges then run slack in the printing press. Also, the pressure upon the paper within the nip of the printing press elongates the paper transversely (crosswise).

In commercial presses for printing single pages, tensions from 2 to 10 pounds per inch are commonly used to take up the slackness in the web edges and to provide the desired web control. Shortening of the web when such tensions are released is not a problem since the pages are individually cut to size. Tensions are also used in the production of continuous business forms, but are usually limited to ½ to 3 pounds per inch in order to limit elastic contractions when the web is released.

To see that the web behaves the same from one stage to the next in the printing of continuous business forms, additional precautions are taken. These include carefully varying the tension from stage to stage in the printing press, storing the web rolls under precise temperature and humidity conditions, running an entire printing operation in a single day to reduce environmental fluctuations, and so on. Where appropriate, the various layers of the multiple layer business form are taken from the same portion of the paper supply roll. (That is, the roll is often double or triple width, so that all forms printed on paper drawn from the right side of the roll are collated with forms drawn from the right side, those from the left are collated with others drawn from the left, and so on.) As a result of these precautions, the web can normally be controlled with a high degree of accuracy. U.S. Pat. Nos. 3,249,316 and 3,592,133, assigned to the assignee of the present invention, describe machinery used for precision web control during the printing process.

If a given length of paper is metered into a press, it follows that a corresponding length of paper will issue from the press. The precision unwind drums disclosed in the above patents meter the paper into the printing press at precisely controlled rates. In some operations, an unwind drum may accordingly be selected to deliver fractionally more paper than desired, and an adjustable snubber is then used to shorten the paper by tensioning it as it is fed onto the drum. By tensioning the paper, the snubber stretches it slightly while it is being metered by the drum, so the effective length of the paper is reduced when the tension is later released. By regulating the snubber, extremely minute changes in the rate that the paper is fed into the press (and hence the length of the paper) can be made.

Occasionally, operating conditions shift sufficiently that normal adjustments of the machinery fail to supply the web at the proper rate. As an example, seasonal fluctuations in temperature and humidity can combine so that no acceptable amount of snubbing will adjust the web properly.

To understand this problem, it must be recognized that changes in the web thickness can affect the rate the web is supplied by the unwind drum. That is, the velocity of the paper web is a function of the "effective radius" of the unwind drum (for a given rate of rotation). The effective radius of the drum is the radius of the drum as measured with respect to the neutral axis of the paper web. This axis includes generally about one-half the thickness of the paper since it is the axis within the web (in the direction of its thickness) on which the web neither shortens (compresses) or elongates (stretches) as it is wound onto the unwind drum. Obviously, in assuming a curved configuration around the drum, the inner surface of the web will necessarily be shorter than the outer surface, so that some shortening or elongation of one surface or the other must take place. At some point within the web (between or on one of the surfaces) neither shortening nor elongation will take place, and this is the neutral axis of the web. Since the neutral axis of the web usually changes with changes in the web thickness, the rate the paper is supplied by the unwind drum can be altered by changes in the web thickness as well as by changes in the drum diameter. The greater the effective radius, the faster the web is supplied.

In an attempt to compensate for environmental fluctuations, electric heaters were used in one unwind drum to increase its effective diameter by means of thermal expansion. Another attempt involved splitting the drum in half and using a jack screw to vary the drum diameter. Still another attempt employed three drums, each of one-half size, and each of slightly different diameter, so that the appropriate drum for the conditions present could be used. Another early attempt involved use of an infinitely variable drive to drive a large size drum. None of these worked. The drum could not be heated satisfactorily; it could not be split accurately; triple drums proved expensive and impractical; and the infinitely variable drives were too coarse and tended to hunt when used to drive large size unwind drums.

Thus there is still a need for a way to vary the effective diameter of the unwind drum, as needed, by an extremely accurate and precisely controlled, yet very minute amount, and to reduce the sensitivity of the unwind drum to changes in the thickness of the paper webs fed thereon.

SUMMARY OF THE INVENTION

Briefly, the present invention provides a web infeed system for power driven web processing equipment. The system includes a drive connection between the printing press line shaft drive and the unwind drum drive gear. The drive connection has at least two independently selectable positive drive trains which may be selectively engaged for driving the unwind drum drive gear. The drive trains provide accurate, positive, and direct drive for the unwind control drum, but differ slightly in the rates they drive the drum. Adjacent rates are generally within .05% of each other, so that the change in the drive ratio for the unwind drum is over a narrow range less than approximately .05%. In the preferred embodiment, one of the positive drive trains provides a straight through drive in which the speed at the output is the same as the input. The other drive train provides a minute increase in speed on the order of .02%, thus increasing the rate of web feed. This has the same effect as an equal percentage increase in the radius of the drum, and can therefore compensate for extreme environmental fluctuations.

Thus, as in the above-mentioned U.S. Pat. Nos. 3,249,316 and 3,592,133, the unwind drum is directly and positively driven from the common line shaft drive which powers the entire printing press. Since all printing press stages are positively driven from the same, common line shaft, they are locked in precise synchronization. This means that even though the changes in speed provided by the present invention are extremely small, they are accurately impressed upon the unwind drum.

This is a substantial improvement over the prior art, since it provides an accurate, reliable, and inexpensive way to change the effective radius of the unwind drum by a precisely controlled amount. As suggested earlier, the need to alter the feed rate from that normally provided does not often arise. However, when a change is necessary, it must be very small and absolutely precise. The earlier attempts mentioned above, such as electrically heating the unwind drum, were expensive, unwieldy, and ultimately did not work.

The drive trains in the present invention employ compound idlers for compactness and economy. Each compound idler is an integral idler set with two separate axially displaced gears. The axially displaced gears of each compound idler rotate as a unit, and have the same or a slightly different number of teeth. A conventional idler produces no speed change. The compound idlers in the present invention produce speed changes in proportion to the slight differences in teeth between the two gears. A pair of compound idlers is then used in each drive train to produce extremely minute speed changes. A speed increasing compound idler and a speed decreasing compound idler are operated in tandem, with the ratios in the two compound idlers being almost but not exactly identical. The net increase (or decrease) is a function of the ratio of the changes caused by the two compound idlers, and is much smaller than that of either idler alone.

In the straight through configuration, a third compound idler is used in another drive train to provide exactly the reverse ratio of the other compound idler remaining in the drive train.

The compound idlers are supported adjacent a common idler wheel plate which is easily pivoted to form a drive train with one or the other of the selectable compound idlers, for changing the drive ratio as desired.

In the above-mentioned U.S. Pat. No. 3,249,316, an unwind drum of relatively large diameter is used, compared with the drum illustrated in the above-mentioned U.S. Pat. No. 3,592,133. In the present invention, a large unwind drum is similarly important. As discussed earlier, due to the extreme precision with which the web feed must be regulated, variations in web thickness are significant. More precisely, variations in the effective radius of the unwind drum alter the rate that the web is fed. Since the effective radius of the drum is the actual radius of the drum plus the distance from the drum surface to the neutral axis of the web, the greater the actual radius of the drum itself, the smaller the percentage change in the effective drum radius for a given absolute change in web thickness. Thus, the larger the drum, the less sensitive it is to changes in web thickness.

As an example, unwind drums having a radius of 17 inches to 18 inches have been used in conjunction with the selectively operable positive drive trains disclosed herein, and have satisfactorily handled paper webs over a thickness range of approximately .001 inches to .01 inches. Preferably, the webs which are fed should alter the effective radius of the unwind drum as related to the neutral axis of the web in an amount generally less than .05%. The ratio of the radius of the unwind control drum to the thickness of the web material fed thereon should therefore generally be greater than 1000 to 1. Of course, the present invention comprehends additional positive drive trains providing additional speed changes each less than approximately .05%, and these would prove particularly useful where it was necessary to use smaller unwind drums. However, such an arrangement is not preferred due to costs and complexity.

It is therefore an object of this invention to provide a web infeed system for web processing equipment in which the web infeed system includes an unwind control drum driven by at least two independently selectable positive drive trains having speed outputs which differ only very slightly in relation to one another, to effect controlled, precise, and minute changes in the rate that the unwind control drum is driven, and to provide an unwind control drum of relatively large radius for use therewith.

Other objects and advantages of the invention will be apparent from the following description, the accompanying drawings and the appended claims.

DESCRIPTION OF THE PREFERRED EMBODIMENT

Figure 1:
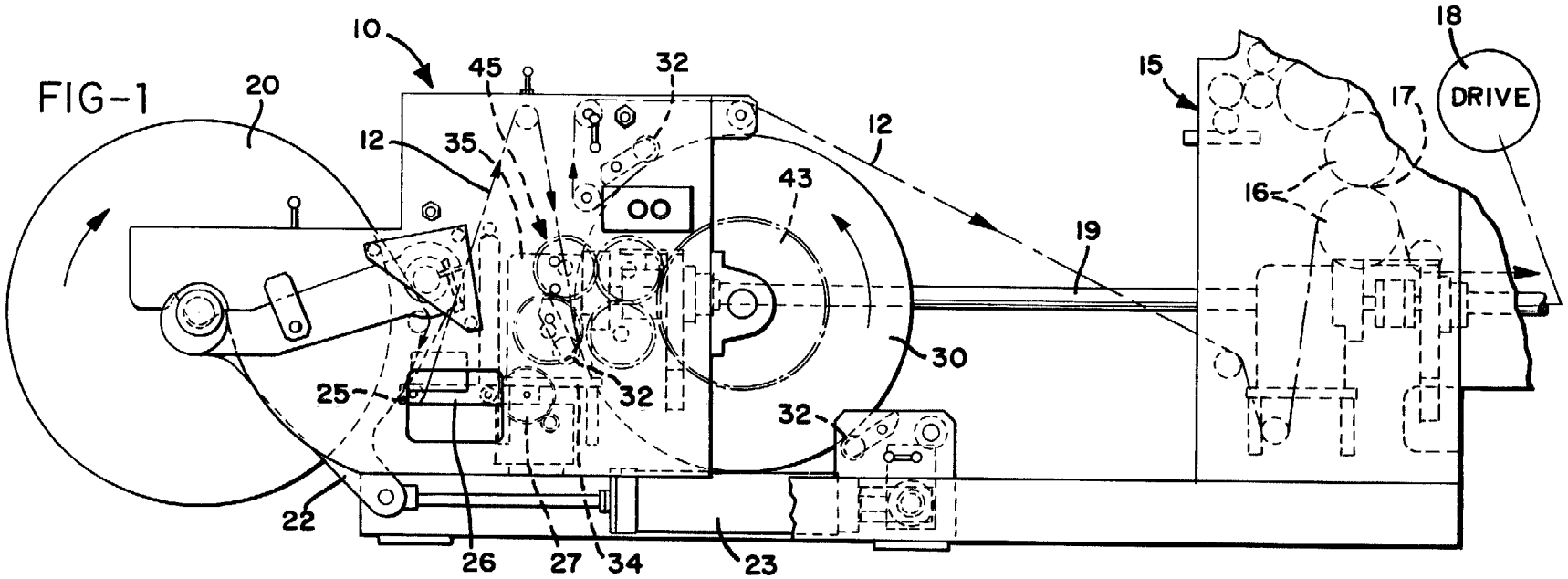
FIG. 1 is a fragmentary and somewhat diagrammatic front elevational view of a web infeed system constructed in accordance with the present invention, and providing web to a lithographic printing press.
Figure 2:
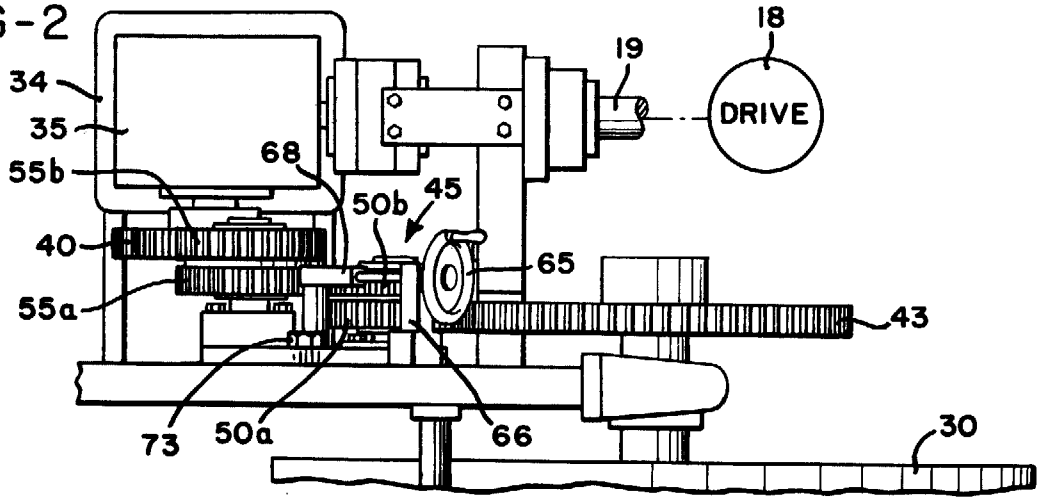
FIG. 2 is a fragmentary top view of the selectively operable drive connection on the backside of the FIG. 1 web infeed system.

FIG. 1 illustrates a web infeed system 10 for supplying a web 12 to web processing equipment 15, such as a rotary printing press. Press 15 includes a printing couple 16 for performing repetitive printing operations on the web. The printing couple 16 has a pair of cylinders which print the web under pressure and drive it through a nip 17 therebetween. A drive means 18 drives the entire line of web processing equipment including the web infeed system 10. The various stations of the web processing equipment 15 and the web infeed system 10 are driven by drive 18 through a common line shaft 19.

A web supply roll 20 is supported by a pair of movable frames 22, one of which is illustrated in FIG. 1. Frames 22 may be raised and lowered by a pneumatic cylinder 23 for loading web supply rolls 20 onto the web infeed system 10, as required.

As the web 12 unwinds from roll 20 it passes around a dancer roll 25. Dancer roll 25 is supported on the end of dancer roll arms 26, one of which rotates a set of unwind brake control gears 27. Dancer roll 25 senses the tension on the web, and, as described more particularly in the above-mentioned U.S. Pat. No. 3,249,316, operates a variable braking means (not shown) to control the rate the web is supplied from web supply roll 20. Roll 25 senses deviations from a predetermined web tension, and these are transmitted through the unwind brake control gears 27 to control the rate the web is supplied, so that the web is paid out on demand related to the requirements of the printing couple.

From the dancer roll 25, the web proceeds to a metering drum such as an unwind control drum 30. Drum 30 is of a large diameter relative to the thickness of the web material normally fed thereon. Preferably, the ratio of the radius of drum 30 to the thickness of the web material 12 is generally greater than 1000 to 1. The most commonly encountered web thicknesses range from approximately .001 inch to .01 inch, and the drum is of sufficiently large diameter that variations of stock thickness over this range will alter the effective radius of the drum 30 as related to the neutral axis of the web 12 in an amount generally less than .05%. Unwind drums having a radius in the range of 16 inches to 17 inches have been found satisfactory.

The web 12 is pressed and held firmly against the unwind control drum 30 by several spring loaded grippers 32. Grippers 32 assure sufficient frictional contact between the web and the drum so that the web does not slip as it is fed therearound.

The web remains in contact with the surface of drum 30 for almost its entire circumference to maximize frictional contact and to assure the best possible control over the web. Upon release from drum 30, the web proceeds to the web processing equipment 15 where the desired repetitive operations are performed.

For driving the unwind control drum 30, a platform 34 supports a right angle transmission 35 on the rear side of the web infeed system 10. Transmission 35 is driven by line shaft 19 to rotate a first drive gear 40 supported thereon. The unwind control drum 30 itself is driven by an unwind drum drive gear 43 attached thereto near the first drive gear 40, and gear 40 and the unwind drum drive gear 43 are drivably interconnected by a selectable drive connection 45. Since the unwind control drum 30 is thus positively driven by the same drive 18 and line shaft 19 which power the remainder of the equipment 15, drum 30 is locked into synchronization with the entire line of web processing equipment.

Drive connection 45 includes two independently selectable positive drive trains having speed outputs which differ only slightly in relation to one another, generally within .05%. These drive trains employ selectable sets of compound idler wheels which change the drive ratio from the drive 18 and shaft 19 to the unwind drum 30 over this narrow range, while providing accurate, finite, and positively determined adjustment of the rate of feed of the web material 12 by the unwind control drum 30.

Figure 3:
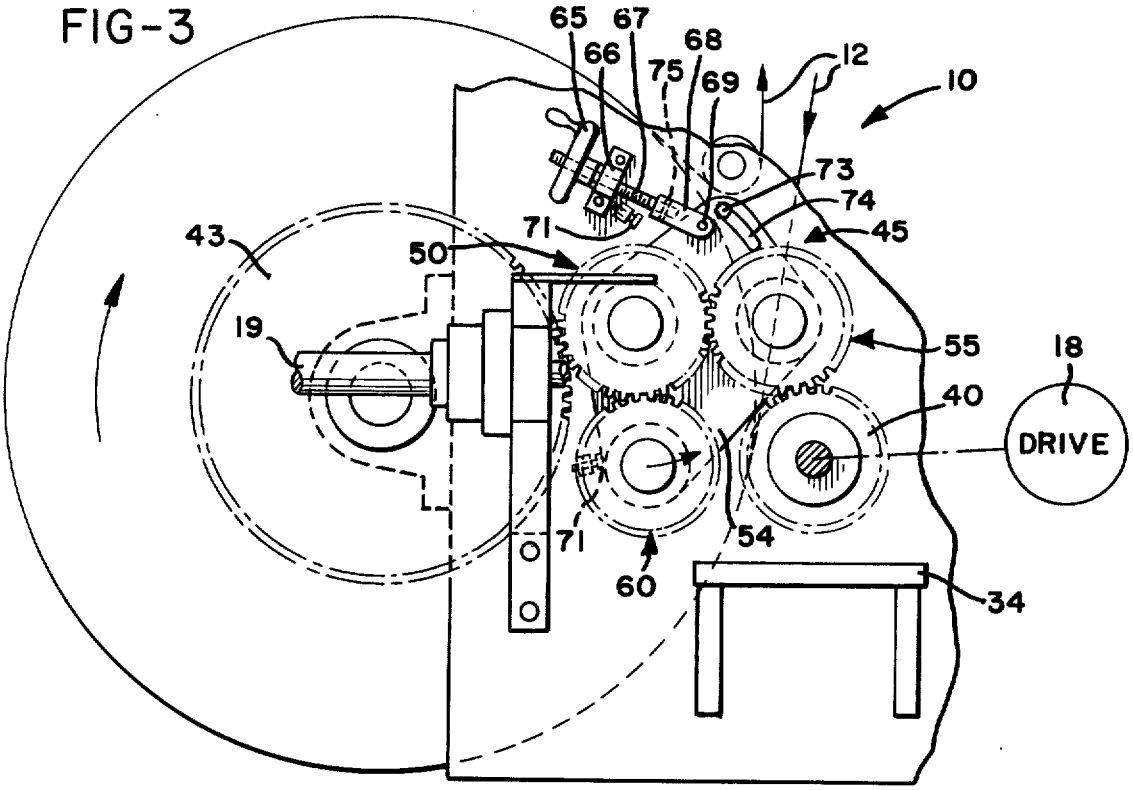
FIG. 3 is a rear view of portions of the FIG. 1 web infeed system showing the speed increasing drive train position.
Figure 4:
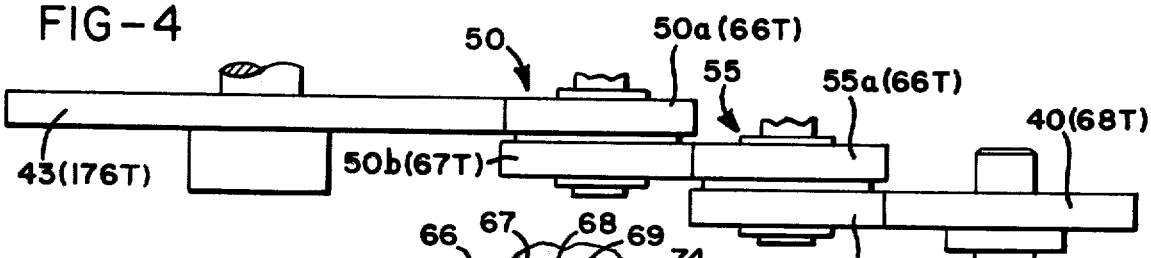
FIG. 4 is a top view schemmatic illustration of the FIG. 3 drive train.
Figure 5:
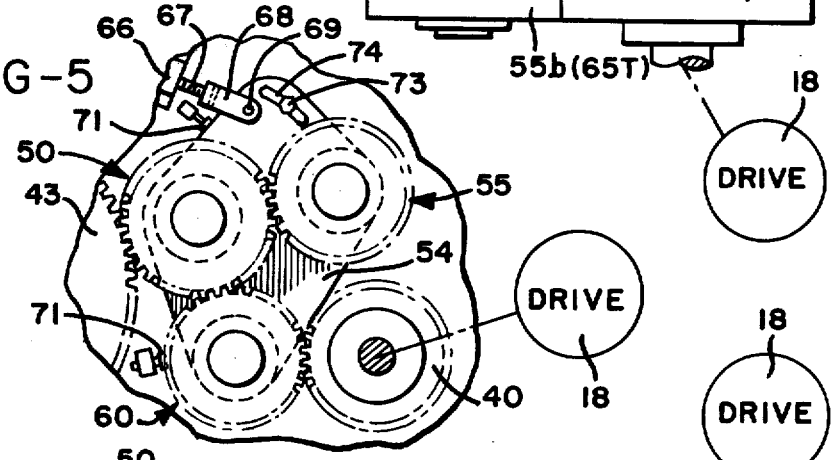
FIG. 5 is a fragmentary view similar to FIG. 3 showing the straight through drive train position.
Figure 6:
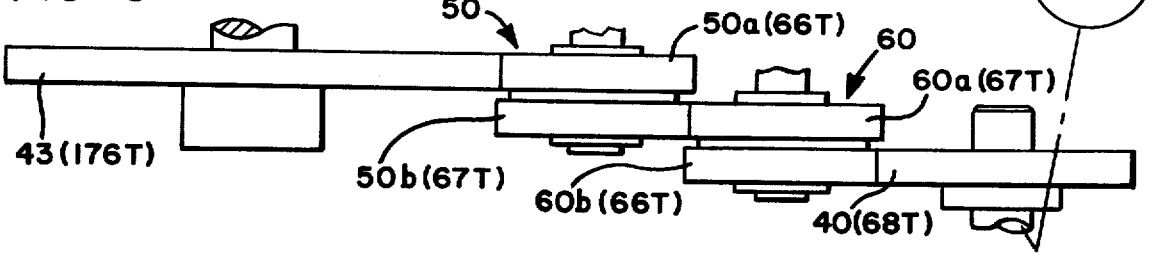
FIG. 6 is a top view schemmatic illustration of the FIG. 5 drive train.

FIGS. 3 and 4 illustrate the first drive train which, in this embodiment, provides a slight speed increasing ratio of approximately 1.000229 for the unwind control drum 30. FIGS. 5 and 6 illustrate the second drive train which provides no increase or decrease in the driving speed of the drum.

Drive connection 45 thus includes a first compound idler 50 mounted for rotation on the backside of the web infeed system 10. Idler 50 includes a first gear **50*a* mounted adjacent and meshed in driving relationship with the unwind drum drive gear 43, and a second gear 50*b* free of driving contact with the unwind drum drive gear 43**.

An idler wheel plate 54 is mounted adjacent compound idler 50 for rotational movement on the same axis of rotation as that of idler 50. Plate 54 supports a second compound idler 55. Idler 55 has a first gear **55*a* and a second gear 55*b*, and is mounted on plate 54 with the first gear 55*a* meshed in driving relationship with the second gear 50*b* of the first compound idler 50**.

A third compound idler 60 is similarly mounted for rotation on idler wheel plate 54. Idler 60 includes a first gear **60*a* and a second gear 60*b* and is mounted on plate 54 so that the first gear 60*a* is meshed with the second gear 50*b* of the first compound idler 50. However, the second and third compound idlers 55 and 60 are displaced from each other on plate 54 so that they are free of driving contact with each other. They are also mounted on plate 54 relatively close to the first drive gear 40, so that slight rotational movement of idler wheel plate 54 about the axis of the first compound idler 50 will selectively mesh either the second gear 55*b* of the second compound idler 55 or the second gear 60*b* of the third compound idler 60 in driven relationship with the first drive gear 40**.

FIGS. 3 and 4 illustrate the drive train configuration which results when idler wheel plate 54 is rotated in a clockwise direction as viewed in FIGS. 3–6 (counterclockwise in FIG. 1). This defines a first position in which the second gear **55*b* of the second compound idler 55 is driven by the first drive gear 40, which in turn is driven by the main drive 18 through line shaft 19** and right angle transmission 35.

FIGS. 5 and 6 illustrate a second drive position in which idler wheel plate 54 is rotated counterclockwise to disengage the second compound idler second gear 55*b* and to mesh the third compound idler second gear 60*b* in driven relationship with the first drive gear 40, completing a second drive train drivably connecting the unwind control drum 30 to drive 18.

Idler wheel plate 54 is moved between the first and second positions by turning a handle wheel 65 which is supported on a strap 66, and which includes a screw thread 67 threadably received through the center of handle 65. Shackle 68 is attached to screw thread 67 by a pin 75. Shackle 68 is attached to plate 54 at a pivot 69, so that as handle 65 is rotated, it threads screw 67 through its center so that plate 54 is rotated counterclockwise as viewed in FIG. 3. Reverse rotation of handle 65 threads screw 67 back through handle 65 and rotates plate 54 in the clockwise direction. Adjustable stops 71 are preset to limit the movement of plate 54 so that the second gears 55*b* and 60*b* of the second and third compound idlers are brought to precisely the proper positions of engagement with the first drive gear 40. A lock screw 73 may be tightened in a slot 74 in plate 54 to lock the plate after it has been moved to the first or second position.

In the illustrated embodiment, the first and second gears 50*a* and 50*b* of the first compound idler 50 have 66 and 67 teeth, respectively (indicated in the drawings by 66T and 67T). Gears 55*a* and 55*b* of the second compound idler have 66 and 65 teeth, respectively, and the third compound idler gears 60*a* and 60*b* have 67 and 66 teeth, respectively. Thus the first drive train between first drive gear 40 and the unwind drum drive gear 43 illustrated in FIGS. 3 and 4 provides a speed increase between gears 40 and 43 of approximately 1.000229. The second drive train illustrated in FIGS. 5 and 6 is straight through and provides no speed increase or decrease.

Both drive trains precisely lock the unwind control drum 30 onto the drive 18 so that the speed of the unwind drum 30 is positively and accurately controlled. The increase in speed provided by the first drive train is extremely small, yet it is accurate and determined. Once the idler wheel plate 54 is moved from the second position (FIGS. 5 and 6) to the first position, the fractional increase in web delivery provided by the unwind control drum will be constant and dependable, without the need for any further adjustment or attention. This is equivalent to a minute increase in the effective radius of the drum 30 as related to the neutral axis of the web 12, and has never before been available.

To increase the versatility of the web infeed system 10, it is possible to use a first drive gear 40 of any appropriate size. In the illustrated embodiment gear 40 has 68 teeth (and unwind drum drive gear 43 has 176 teeth). However, a first drive gear 40 of a different size may be fitted simply by shifting the right angle transmission 35 and its platform 34 horizontally along line shaft 19, as required, to define new positions for selective engagement of the first drive gear with the second and third compound idler second gears 55*b* and 60*b*. Stops 71 are then adjusted to the new first and second positions for plate 54. As may be seen (FIG. 5), slot 74 is much longer than necessary for a 68 tooth first drive gear 40, in order to accommodate first drive gears 40 of other sizes.

As may be seen therefore, the present invention provides numerous advantages. It is uncomplicated and inexpensive, yet accurate and highly reliable. It provides the equivalent of an extremely small increase in the effective radius of the unwind control drum 30 and is far more dependable and consistent than earlier attempts at such control. As indicated, the operational speed of the unwind control drum 30 is normally sufficient without a speed increase. On occasion, however, the effective radius must be increased, but only by an extremely small amount. With the present invention this is now possible.

Another advantage of the present invention is the considerable savings of space provided by the compound idlers. In the illustrated embodiment, the first position of FIGS. 3 and 4 accomplishes an extremely small increase using a total of only 264 teeth on the first and second compound idlers. This result is obtained by using a speed increasing ratio of 66 to 65 and using a speed decreasing ratio of 66 to 67. The net increase is the product of these fractions, which is orders of magnitude smaller than either taken alone.

While the form of apparatus herein described constitutes a preferred embodiment of this invention, it is to be understood that the invention is not limited to this precise form of apparatus, and that changes may be made therein without departing from the scope of the invention.

What is claimed is:

1. In a web infeed system for a rotary printing press having a printing couple including a pair of cylinders adapted to print the web under pressure and drive the web through a nip formed by said cylinders, drive means for driving said printing couple, a web supply roll, means supporting said supply roll for paying out the web on demand related to the requirements of said printing couple, and a metering drum intermediate said web supply and said printing couple for unwinding the web from said supply and feeding it to said nip, the improvement comprising:

drive train means connected to said metering drum with direct gearing from said printing couple drive means at independently selectable different speeds the outputs of which differ in relation to the input speed from said drive means generally within .05% of one another, said drive train means including:

a. an imput drive gear driven by said drive means, b. a metering drum drive gear connected to rotate said metering drum, c. one of said input and metering drum drive gears being a first drive gear and the other being a second drive gear, d. a first idler set having at least two gears and being mounted adjacent said first drive gear with a first gear of said first idler set meshed with said first drive gear, e. a second idler set having at least two gears and being mounted with a first gear thereof meshed with a second gear of said first idler set, f. a third idler set having at least two gears and being mounted with a first gear thereof meshed with said second gear of said first idler set, said third idler set being free of driving contact with said second idler set, g. means mounting said second drive gear adjacent the second gears of said second and third idler sets, h. means for alternatively meshing said second drive gear with one or the other of the second gears of said second and third idler sets, and i. one of said first and second idler sets providing a speed increasing ratio and the other a speed decreasing ratio to provide a net speed change which is the product of their ratios and is an increase or decrease of generally less than 0.5%.

2. The web infeed system of claim 1 wherein said first drive gear is said metering drum drive gear and said second drive gear is said input drive gear.

3. The web infeed system of claim 1 wherein said first drive gear is said input drive gear and said second drive gear is said metering drum drive gear.

4. The web infeed system of claim 1 wherein said metering drum is of such large diameter that feed of web over a thickness range of approximately .001 inch to .01 inch alters the effective radius of said drum as related to the neutral axis of the web in an amount generally less than .05%.

5. The web infeed system of claim 1 wherein said drive train means further comprises:

a. an idler wheel plate mounted adjacent said first idler set for movement about the axis of rotation thereof, b. said second idler set being mounted on said idler wheel plate, c. said third idler set being mounted on said idler wheel plate, and d. means for moving said idler wheel plate between:

i. a first position wherein said second idler set second gear is meshed with said second drive gear, and ii. a second position wherein said third idler set second gear is meshed with said second drive gear.

6. The web infeed system of claim 1 wherein a. said first gear of said first idler set has fewer teeth than said second gear thereof to provide an effective speed increasing gear ratio, and b. said first gears of said second and third idler sets have more teeth than their respective second gears to provide effective speed decreasing gear ratios.

7. The web infeed system of claim 1 wherein a. said first gear of said first idler set has more teeth than said second gear thereof to provide an effective speed decreasing gear ratio, and b. said first gears of said second and third idler sets have fewer teeth than their respective second gears to provide effective speed increasing gear ratios.

8. The web infeed system of claim 1 wherein said means mounting said second drive gear adjacent said second and third idler sets is adjustable to accommodate second drive gears of various sizes for selective meshing with said second and third idler sets.

9. The system of claim 1 further comprising means controlling the paying out of the web from said web supply, including:

a. means for sensing web tension between said supply and said drum, and b. variable braking means operative to control the rate the web is supplied from said supply in response to deviations from a predetermined web tension as sensed by said web tension sensing means.

10. The system of claim 1 wherein the number of teeth on the first gear of one of said idler sets differs from the number of teeth on the second gear thereof generally less than approximately 5%.

11. The system of claim 10 wherein:

a. said first gear of said first idler set has 66 teeth, b. said second gear of said first idler set has 67 teeth, c. said first gear of said second idler set has 66 teeth, d. said second gear of said second idler set has 65 teeth, e. said first gear of said third idler set has 67 teeth, and f. said second gear of said third idler set has 66 teeth.

12. In a web infeed system for a rotary printing press having a printing couple including a pair of cylinders adapted to print the web under pressure and drive the web through a nip formed by said cylinders, drive means for driving said printing couple, a web supply roll, means supporting said supply roll for paying out the web on demand related to the requirements of said printing couple, and a metering drum intermediate said web supply and said printing couple for unwinding the web from said supply and feeding it to said nip, the improvement comprising:

drive train means connected to said metering drum with direct gearing from said printing couple drive means at independently selectable different speeds the outputs of which differ in relation to the input speed from said drive means generally within .05% of one another, said drive train means including at least two independently selectable drive trains, one of said drive trains having at least two gear sets, each having at least two gears, said gear sets being arranged in series driving relationship, one of said gear sets providing a speed increasing ratio and the other a speed decreasing ratio to provide a net speed change which is the product of their ratios and is an increase or decrease of generally less than 0.5%.

* * * * *